US006247212B1

(12) United States Patent
Graña Iglesias

(10) Patent No.: US 6,247,212 B1
(45) Date of Patent: Jun. 19, 2001

(54) RETENTION DEVICE FOR SOLIDS IN DRINKING GLASSES

(75) Inventor: Angel Manuel Graña Iglesias, Cangas (ES)

(73) Assignees: George Triliouris; Ana Triliouris, both of Old Westbury, NY (US)

( * ) Notice: Subject to any disclaimer, the term of this patent is extended or adjusted under 35 U.S.C. 154(b) by 0 days.

(21) Appl. No.: 09/438,649

(22) Filed: Nov. 12, 1999

(30) Foreign Application Priority Data

Nov. 24, 1998 (ES) ..... 9802960 U

(51) Int. Cl.[7] ..... H60R 21/20
(52) U.S. Cl. ..... 24/563; 24/3.1; 210/469
(58) Field of Search ..... 24/3.1, 3.12, 502, 24/563, 545, 570; 210/469; 220/710.5, 703; 215/386, 387, 390

(56) References Cited

U.S. PATENT DOCUMENTS

D. 315,478 * 3/1991 Liggens ..... D7/667
2,106,453 * 1/1938 Exdahl ..... 210/469
2,357,063 * 8/1944 Swing ..... 210/469
2,744,631 * 5/1956 Toombs ..... 210/469
2,766,889 * 10/1956 Rey ..... 210/469
4,020,532 * 5/1977 Lichter ..... 25/562
5,727,712 * 3/1998 Costello ..... 220/703

FOREIGN PATENT DOCUMENTS

9601515 U 5/1996 (ES) .

* cited by examiner

*Primary Examiner*—Robert J. Sandy
(74) *Attorney, Agent, or Firm*—Collard & Roe, P.C.

(57) ABSTRACT

A device for retaining solids in a drinking glass comprising a clamp connected to a grid via a hinge. The clamp and grid are initially positioned flat but upon rotation of the hinge, the clamp and grid are positioned perpendicular to each other for use. The flat configuration makes manufacturing and shipping easier and less expensive. Upon rotation of the hinge, the clamp and grid are locked into the perpendicular position via interlocking elements on the clamp and grid. The grid prevents solids in the glass from traveling with the liquid as the glass is being tilted, thus eliminating spills and discomfort to the user.

3 Claims, 3 Drawing Sheets

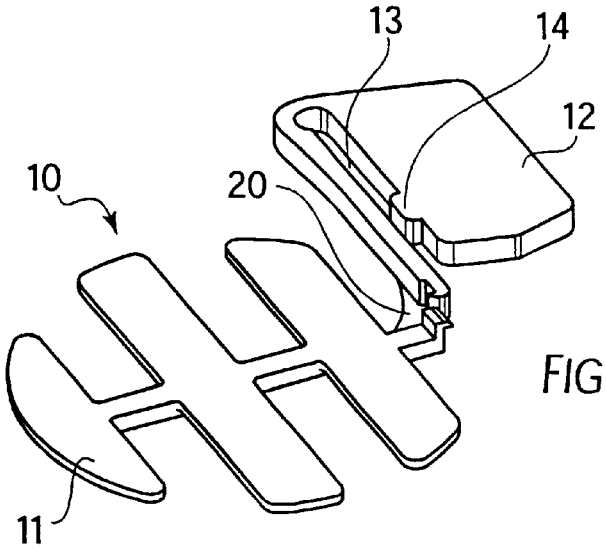
FIG. 1
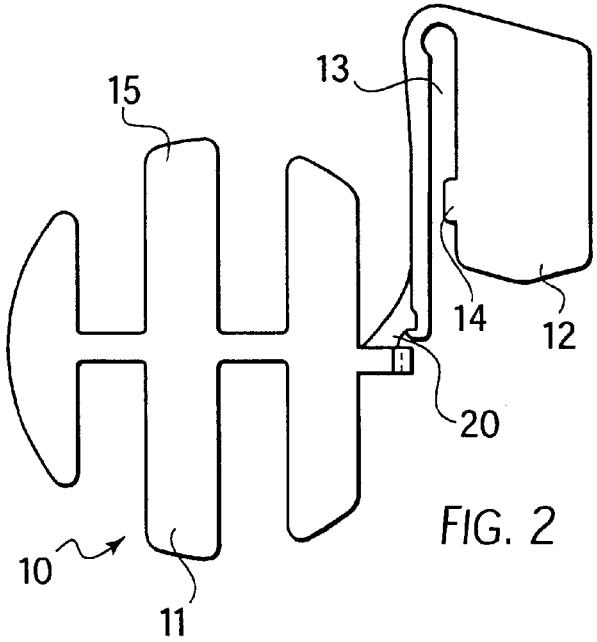
FIG. 2
FIG. 3
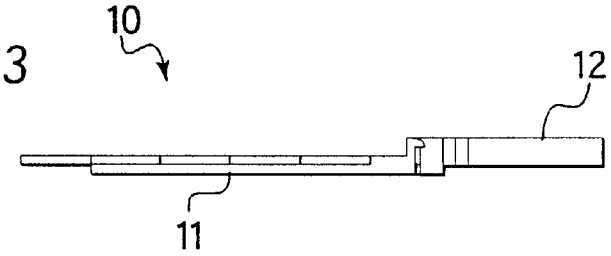

FIG. 4
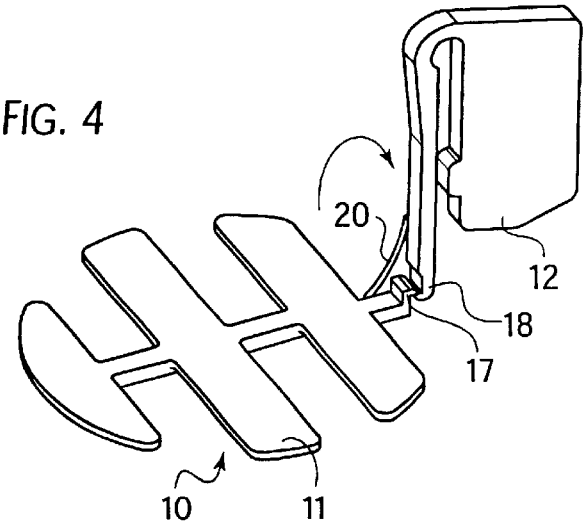
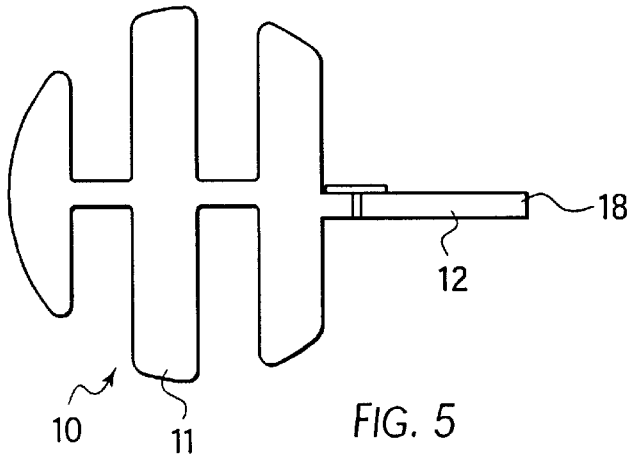
FIG. 5
FIG. 6
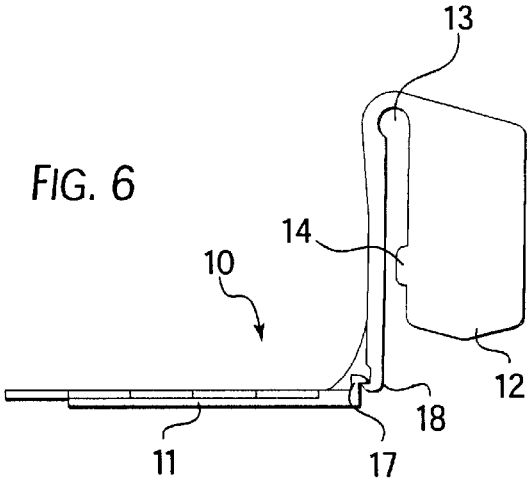

RETENTION DEVICE FOR SOLIDS IN DRINKING GLASSES

BACKGROUND OF THE INVENTION

1. Field of the Invention

This invention relates to a device for retaining solids such as ice cubes, fruit, etc. in drinking glasses. In particular, the device comprises grid or filter that is maintained at a certain depth into the glass and joined to it via a clamp that secures the whole device to the edge of the glass. The function of the device is to filtrate and keep the solids away from the user's mouth as the glass is inclined for drinking. The device keeps the solids from hitting the drinker's mouth, thus preventing discomfort and spillage.

2. The Prior Art

There are some devices for keeping solids in the glass that have been used in the past, but all of them suffer from various drawbacks. Many of them comprise several pieces that need to be coupled together. One device is a folded device, but it comprises three or four different parts that are connected by two or three joints. None of these devices provide a stable configuration.

Spanish Utility Model No. U-9601515 discloses a solids retainer for drinking glasses that overcomes some of the drawbacks of the prior art, but also suffers from drawbacks of its own. In particular, the device is not easy to handle and requires an excessive amount of room for packaging, storage and shipment. It also lacks hygiene when the final consumer affixes it to their glass.

SUMMARY OF THE INVENTION

It is therefore an object of the present invention to provide a solids retainer from a drinking glass that overcomes the drawbacks of the prior art and is molded from one piece.

It is another object of the invention to provide a solids retainer that is compact in structure and easy to operate.

It is another object of the invention to provide a solids retainer that can be folded flat for ease of packaging and shipping.

These and other objects of the invention are accomplished by a solids retainer for a drinking glass comprising:

The device according to the invention presents a new structure that allows a simple transition from an initial planar configuration for shipping to another configuration that represents the solids retainer. This has the advantage that it very simple to manufacture, and cuts the manufacturing time, since the mold is a simple design. The manufacturing mold is also very versatile and can accommodate design changes. In addition, the amount of room needed for packaging is reduced, as are the shipping costs.

The device comprises a horizontal grid that is introduced into the glass and secured to the glass by a clamp with a handle. The handle allows the handling of the whole device without touching the pieces that are in contact with the liquid or foods. This is a much more sanitary configuration than the prior solids retainers. The device is also simple and more comfortable to operate.

The invention is preferably a single piece that forms two solid parts: the clamp and the grid. The clamp and grid are connected by a hinge. The hinge is preferably a living hinge, i.e., created by a decrease in thickness of the material between the grid and clamp, thus allowing the entire device to be manufactured in one piece. There is an axis of rotation along the hinge which runs perpendicular to the longitudinal expanse of the device, and allows for effortless articulation of the two parts. The rotation of the two components along the hinge can be accomplished by a single movement into the correct position. Once the operating position is achieved, the device has a stable configuration and will not bend back into the flat shape. Thus, it is maintained firmly and safely during normal usage of the device, even when it is reused in another glass.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 1 shows a perspective view of the device according to the invention in the flat configuration;

FIG. 2 shows a top view of the device of FIG. 1;

FIG. 3 shows a side view of the device of FIG. 1;

FIG. 4 shows a perspective view of the device according to the invention in the folded position;

FIG. 5 shows a top view of the device of FIG. 4;

FIG. 6 shows a side view of the device of FIG. 4;

DETAILED DESCRIPTION OF THE PREFERRED EMBODIMENT

Referring now in detail to the drawings and, in particular, FIGS. 1–3, there is shown the device 10 according to the invention in a planar configuration. Device 10 comprises a grid 11 connected via a hinge 20 to a clamp 12. Clamp 12 forms a handle for attaching device 10 to a glass, and permits the user to do so without touching grid 11, which contacts the liquid in the glass.

Figure 8:
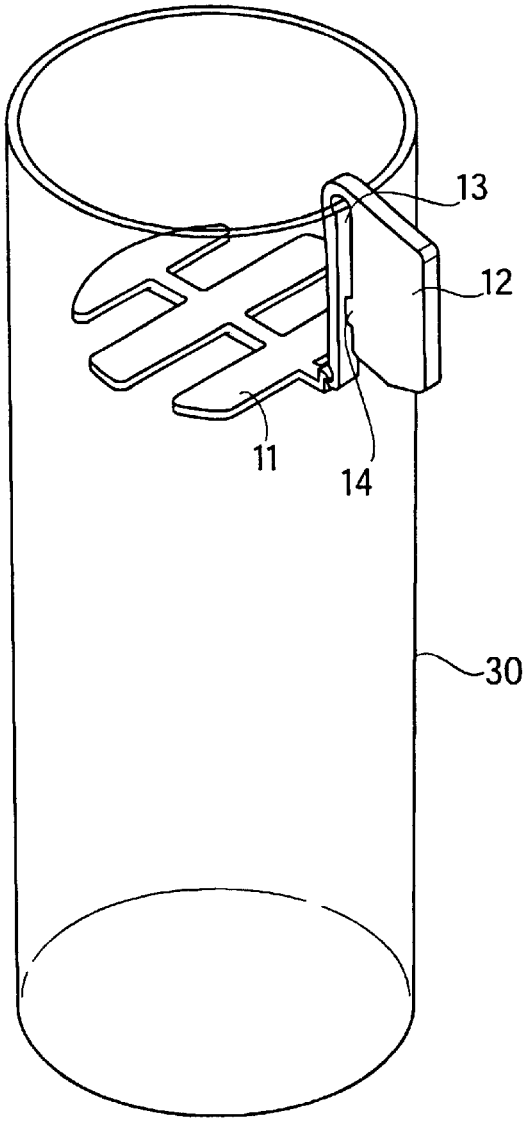
FIG. 8 shows a perspective view of the device according to the invention as mounted on a glass.

Hinge 20 is preferably a "living hinge", i.e., it is formed by a decrease in thickness of the material between grid 11 and clamp 12, thus allowing device 10 to be formed from a single piece of plastic. Clamp 12 has a cleft 13 in which the edge of a glass is slid for mounting, as shown in FIG. 8. A protrusion 14 extends into cleft 13 and attaches device 10 to glass 30 more securely.

Figure 7:
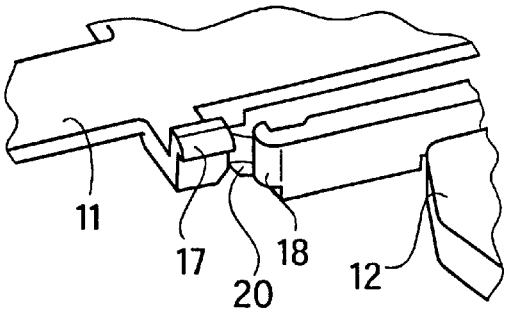
FIG. 7 shows an enlargement of the hinge portion of the device shown in FIG. 1.

Grid 11 is formed from several arms 15, which keep solids within the glass, but permit the flow of liquid therethrough. To use device 10, hinge 20 is pivoted around axis 18 so that grid 11 and clamp 12 are placed perpendicular to one another, as shown in FIGS. 4–6. To keep grid 11 and clamp 12 in the folded position, grid 11 has an L-shaped locking element 17, which interlocks with an L-shaped locking element 18 on clamp 12 when hinge 20 is actuated, as shown in FIGS. 6 and 7. A slight pressure and displacement is required to interlock elements 17 and 18, but once they are locked, device 10 remains stable in the folded configuration.

Device 10 is preferably individually packaged in a flexible package containing instructions for its operation and for avoiding direct manual contact with the components that will be submerged in the drinking liquid.

Accordingly, while only a single embodiment of the present invention has been shown and described, it is obvious that many changes and modifications may be made thereunto without departing from the spirit and scope of the invention.

What is claimed is:

1. A device for retaining solids in a drinking glass, comprising:

a grid having a planar body adapted to filter liquid therethrough but keep solid particles on one side of said planar surface, a clamp having a planar body with a cleft for receiving the edge of a drinking glass;

a hinge connecting said grid and said clamp, said hinge being pivotable such that said grid and said clamp are initially positioned co-planar with each other, and wherein pivoting said hinge places said grid perpendicular to said clamp, so that when said clamp is attached to a drinking glass in a vertical position, the grid is horizontal and prevents solids from rising above the grid; and an L-shaped element on said grid adjacent said hinge, and a second L-shaped element on said clamp adjacent said hinge, such that pivoting said hinge to place the grid and clamp perpendicular to one another causes the L-shaped elements to interlock and lock the grid and clamp into a perpendicular position.

2. The device according to claim 1, wherein the clamp and grid are molded from a single piece and wherein the hinge is a living hinge.

3. The device according to claim 1, further comprising a protrusion located along the cleft and causing the cleft to narrow in one location, said protrusion securing the clamp to a glass when a glass is inserted in the cleft.

* * * * *